US005931539A

United States Patent [19]

Saiz

[11] Patent Number: 5,931,539

[45] Date of Patent: Aug. 3, 1999

[54] DEVICE TO REDUCE WEIGHT OR LOAD ON THE SPINAL COLUMN FOR SEATS AND THE LIKE

[76] Inventor: Manuel Munoz Saiz, San Emilio 16,1,3, Madrid, Spain, 28017

[21] Appl. No.: 08/995,970

[22] Filed: Dec. 22, 1997

[30] Foreign Application Priority Data

Nov. 25, 1997 [ES] Spain ..... 9702463

[51] Int. Cl.[6] ..... A47C 31/00; A62B 35/00

[52] U.S. Cl. ..... 297/465; 297/464; 297/219.1

[58] Field of Search ..... 297/465, 219.1, 297/464, 485, 486, 452.36, 452.35

[56] References Cited

U.S. PATENT DOCUMENTS

| | | | |
|---|---|---|---|
| 2,782,839 | 2/1957 | Cole | 297/485 X |
| 3,099,486 | 7/1963 | Scott | 297/465 |
| 3,179,360 | 4/1965 | Shelton et al. | 297/465 X |
| 3,197,255 | 7/1965 | Caudill | 297/452.36 |
| 3,560,048 | 2/1971 | Flint | 297/465 |
| 3,827,716 | 8/1974 | Vaughn et al. | 927/465 X |
| 3,992,040 | 11/1976 | Gannac | 297/465 |
| 4,093,307 | 6/1978 | McLennan | 297/485 |
| 4,639,946 | 2/1987 | Koenig | 297/465 |
| 4,979,779 | 12/1990 | Williams | 297/465 |
| 4,981,307 | 1/1991 | Walsh | 297/465 X |
| 5,080,191 | 1/1992 | Sanchez | 297/465 X |
| 5,123,699 | 6/1992 | Warburton | 297/219.1 |
| 5,148,563 | 9/1992 | Klearman et al. | 297/465 X |
| 5,154,487 | 10/1992 | Warburton | 297/465 |
| 5,301,371 | 4/1994 | Chao | 297/465 X |
| 5,354,121 | 10/1994 | Allum | 297/485 |
| 5,407,248 | 4/1995 | Jay et al. | 297/464 X |
| 5,544,363 | 8/1996 | McCue et al. | 297/465 X |

FOREIGN PATENT DOCUMENTS

| | | | |
|---|---|---|---|
| 166141 | 7/1987 | Japan | 297/465 |
| 1185153 | 3/1970 | United Kingdom | 297/465 |
| 3005986 | 4/1993 | WIPO | 297/465 |

*Primary Examiner*—Peter M. Cuomo
*Assistant Examiner*—Rodney B. White
*Attorney, Agent, or Firm*—Robert M. Schwartz

[57] ABSTRACT

A device to reduce weight or load on the spinal column for seats and the like that comprises two parts, the first being of two curved fins running from the edges of a chairback to adopt the anatomical form of the user's sides from the waist to the axillae, while the second is an elastic vest or corset covering the whole of the trunk from the waist to the axillae and shoulders. The vest secures at its top to the chairback by braces and fasteners or hooks. these braces secure to the back of an upward extension to the chairback.

4 Claims, 5 Drawing Sheets

DEVICE TO REDUCE WEIGHT OR LOAD ON THE SPINAL COLUMN FOR SEATS AND THE LIKE

CROSS-REFERENCES TO RELATED APPLICATIONS

This patent claims the priority date of Spanish Patent P9702463 filed on Nov. 25, 1997. The basis for priority in this case is the Paris Convention for the Protection of Industrial Property (613 O.G. 23, 53 Stat 1748). The Spanish patent application was filed in The Official Patent and Trademark Office of Spain.

BACKGROUND OF THE INVENTION

1. Field of the Invention

This invention refers to a chair-like device for use in spinal column rehabilitation or therapy.

2. Description of the Prior Art

With existing seats, virtually all of the weight of the head, trunk, and upper limbs presses on the vertebrae, particularly the lumbar vertebrae, as well as on the gluteus, pelvis, upper portions of the femur, and the muscles associated with all of these.

SUMMARY OF THE INVENTION

The invention encompasses an apparatus. The apparatus comprises two parts: a vest and curved fins. The apparatus works to distribute the user's weight while sitting.

The vest works by surrounding the user's torso. The vest connects to the back of a chair. The vest acts to suspend the user and helps to the distribute the user's weight.

In one form, the vest works by using suspenders that run under the user's shoulders and attach to the upper extension of the chairback. A band may be used, which may be elastic, running around the back at the level of the axillae, with both ends of said band coming forward through the axillae and continuing to the upper part of the extended chairback, to which they are fitted.

In a second embodiment, vertical elastic straps that are under tension connect the upper extension of the chairback to a vest. The vest is also known as waistcoat or corset. This combination works to distribute the weight to reduce stress. The elastic vests (waistcoats) or corsets may be formed by vertical elastic straps allowing the stress to be distributed by zones and with circular reinforcing bands around the waist and the area of the arm opening. The vest may also include horizontal bands that run parallel to the user's waist. The vest may be closed by a variety of means including clasps, a velcro belt, or similar closure.

The curved fins run from the edges of a chairback forward and curve inwardly, toward the user's front. The fins adopt the anatomical form of the user's sides. The fins contact the user's trunk from the waist to the axillae and shoulders. The curved fins hold or press the sides, axillae, and waist to the chairback. The fins also press upwards. The fins may be made up internally of flexible ribs with a foam-rubber lining able to adapt to the anatomical form of each individual user. To use such a chair, the user enters the chair by dropping vertically and becoming attached and suspended in a controlled manner.

The fins can also be configured to close as the user sits. Each fin is connected at its bottom to a horizontal plate. The angle at which the fins intersect the plates is fixed. Attached to the chair back are swivels. The swivels are rods around which the plate/fin unit can rotate. Lying on top of the plates is the seat padding. In this way, as the user sits on the padding, the plates are pressed down at their center, the joined fins rotate on the swivels, the fins compress to the user's sides. The fins can also swivel around the vertical chairback supports.

The fins may be inflatable and be incorporated into the seat.

The fins may be adaptable to certain existing seats. In this way, a normal chair could have an apparatus slid over its chairback.

Similarly, any of the embodiments can comprise a chair with a removable apparatus. By being removable, the chair could be used in conjunction with apparatus or without the apparatus as a "normal" chair.

Springs or magnetic elements may be added to retain them in their various positions.

Finally, the fins may be flat, supporting the abdomen at the back and sides only.

The apparatus can further comprise and adjustable padding. In the case of apparatuses utilizing harnesses, changing the height can change the tension. In the case of fins and plates, the level at which the fins are applied to the user's sides can be adapted by altering the height of the padding used.

In addition, there may be no base or seat, so that the body is entirely suspended, secured laterally from the trunk.

The chairback can include a removable upward extension attached.

All elements referred to make it possible to raise or adjust the upper part of the trunk, whether operating separately or together.

Advantages

The invention reduces weight and, therefore, pressure between the dorsal and lumbar vertebrae as well as reduced stress between the associated muscles and tendons. The spinal column is stretched, separating the vertebrae from one another. Scoliosis is avoided or reduced. Longer, seated periods are possible. Weight is reduced on the gluteal zones, improving blood circulation in the legs. Another advantage is enhanced post-operative or therapeutic recovery from lesions due to compression of the vertebrae. Persons with spinal column problems can be bed-ridden for shorter times. Medicine and rehabilitation costs are cut. The invention is also useful for persons who are seated for long periods, whether they have lesions or not. Finally, compared to the alternatives the invention is economical and simple.

DETAILED DESCRIPTION OF THE PREFERRED EMBODIMENTS

Figure 1:
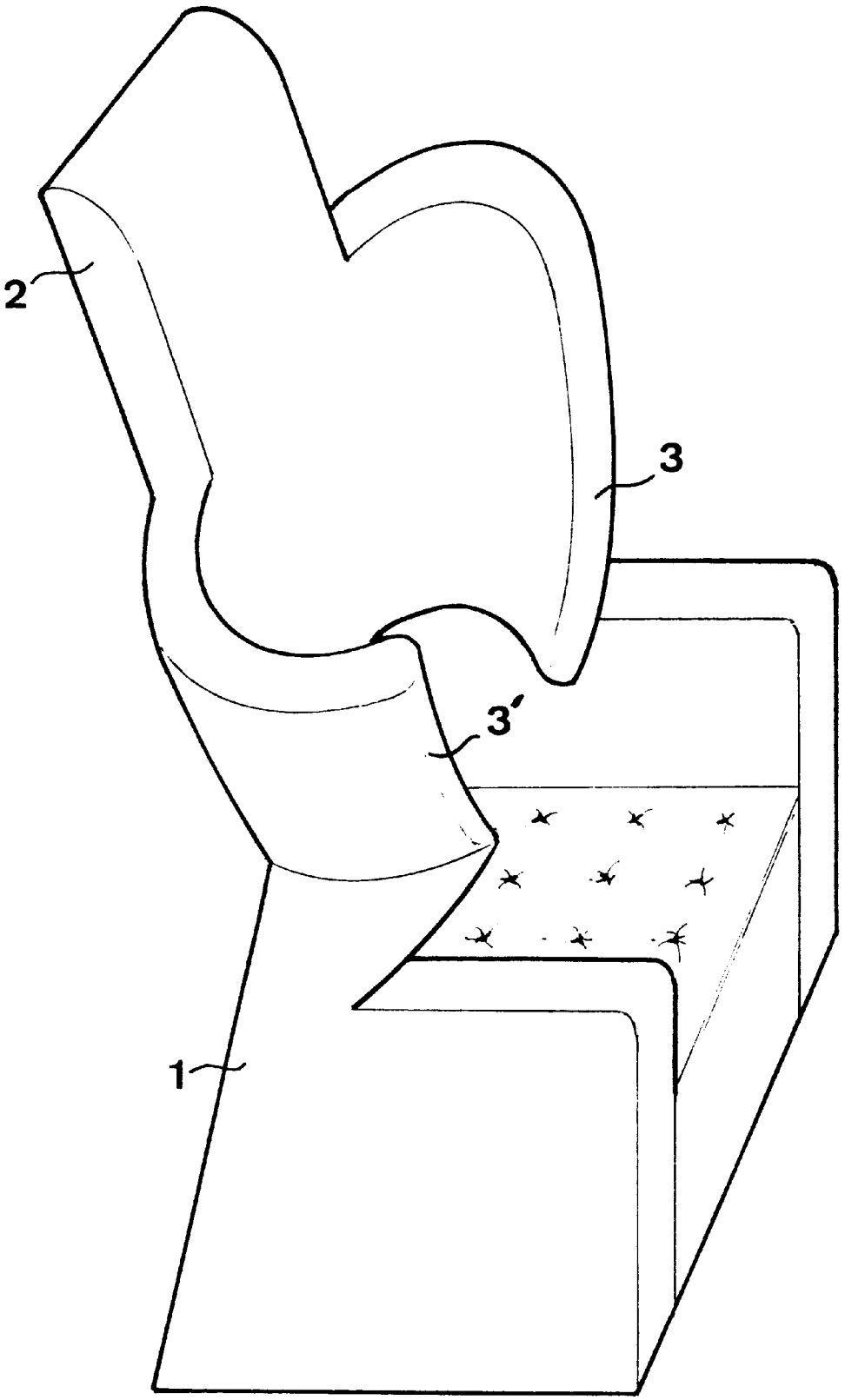
FIG. 1 shows a perspective view of a seat with the fins in the invention.

FIG. 1 comprises the seat 1, the chairback 2, and the curved fins 3 and 3'.

Figure 2:
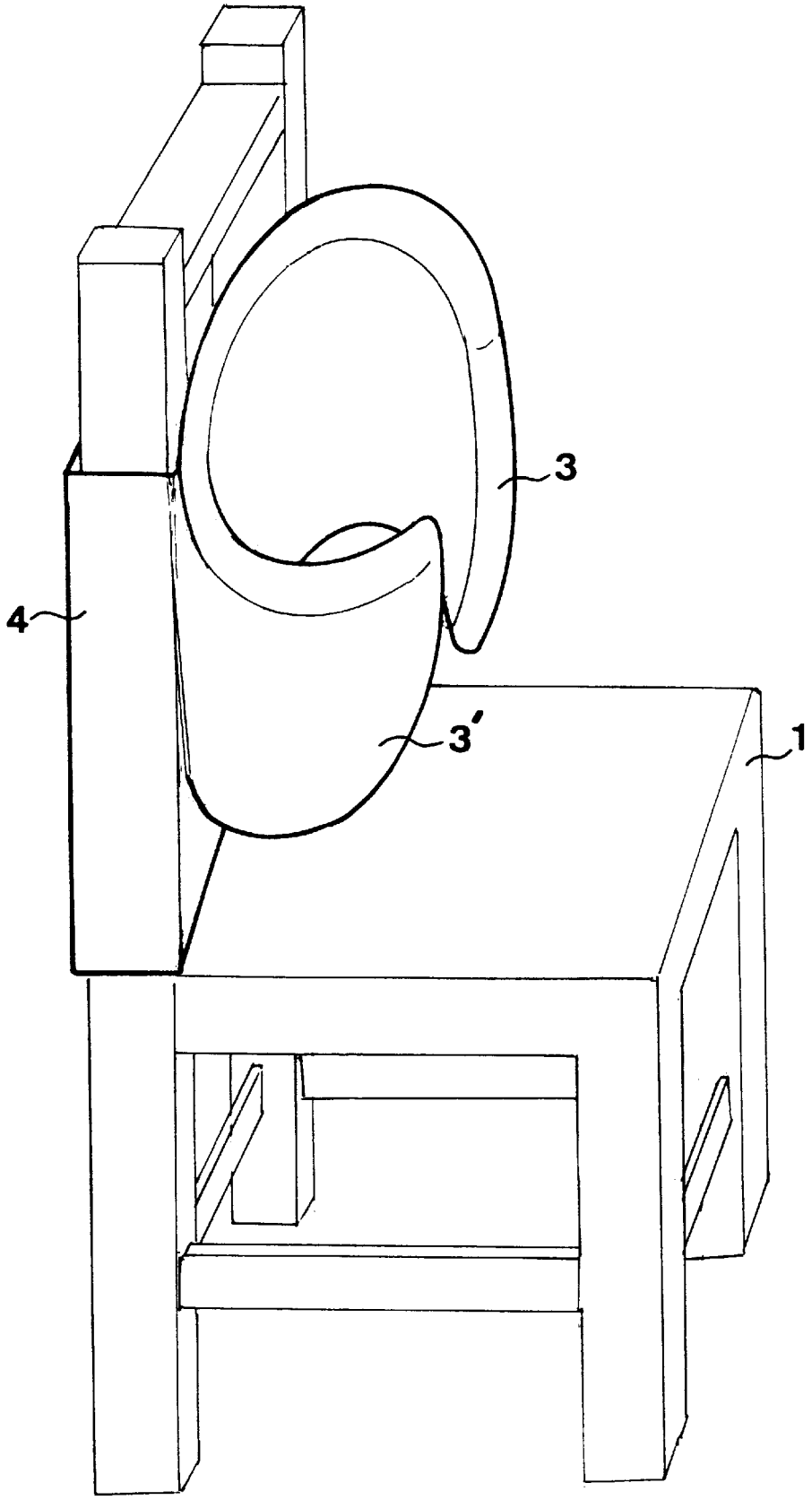
FIG. 2 shows a perspective view of a fin variant.

FIG. 2 comprises the seat 1, the side curved fins 3 and 3', and the removable support and fitting piece of the fins 4.

Figure 3:
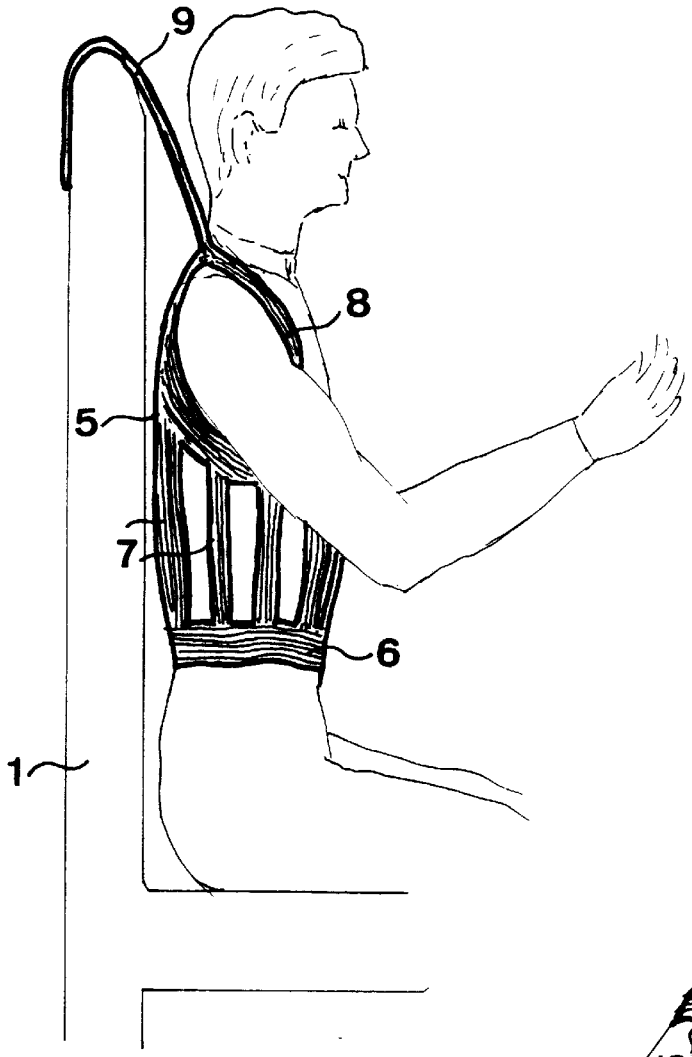
FIG. 3 shows a side view of the vest of the invention.

FIG. 3 comprises the seat 1, the vest, the elastic bands 6, the elastic straps 7, the reinforcing bands 8, and the elastic braces 9 that can be fastened by clasps. A band at the level of the axillae running around the chest works in the same way as the one around the waist.

Figure 4:
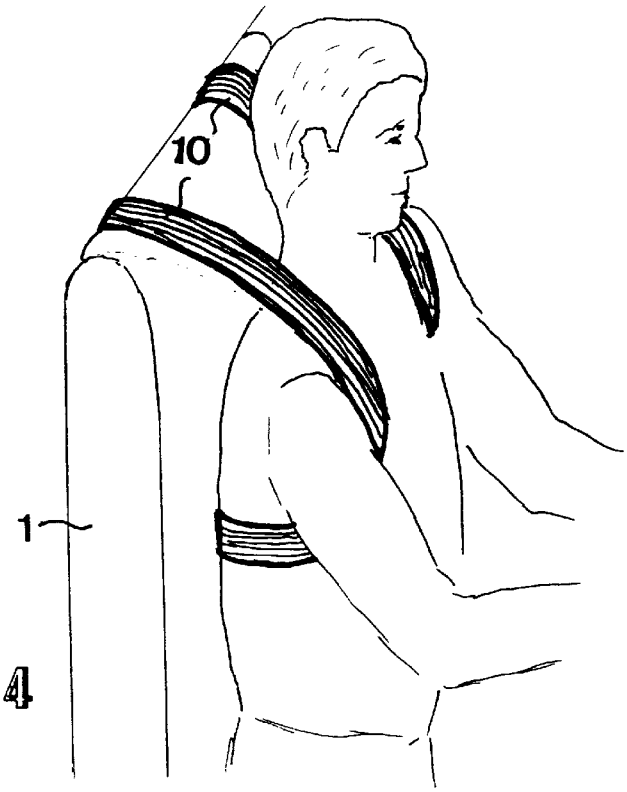
FIG. 4 shows a perspective view of a variant using support bands.

FIG. 4 comprises the seat 1, the elastic band 10, wherein said band runs around the back at the level of the axillae, with both ends of said band coming forward through the axillae and continuing to the upper part of the extended chairback, to which they are fitted.

Figure 5:
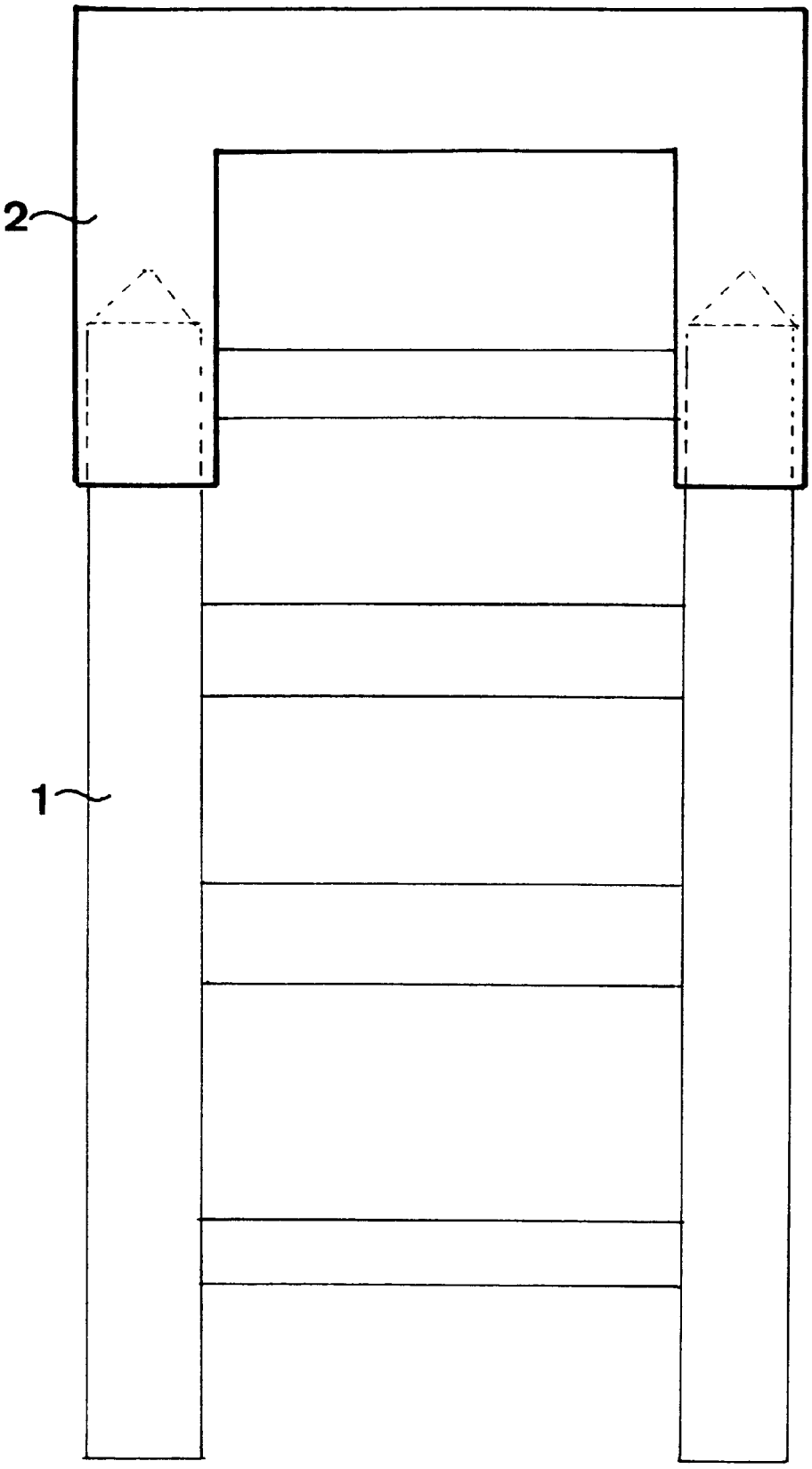
FIG. 5 shows a rear view of an upward extension to the chairback.

FIG. 5 comprises the seat 1 and the extended element of the chairback of the seat 2.

Figure 6:
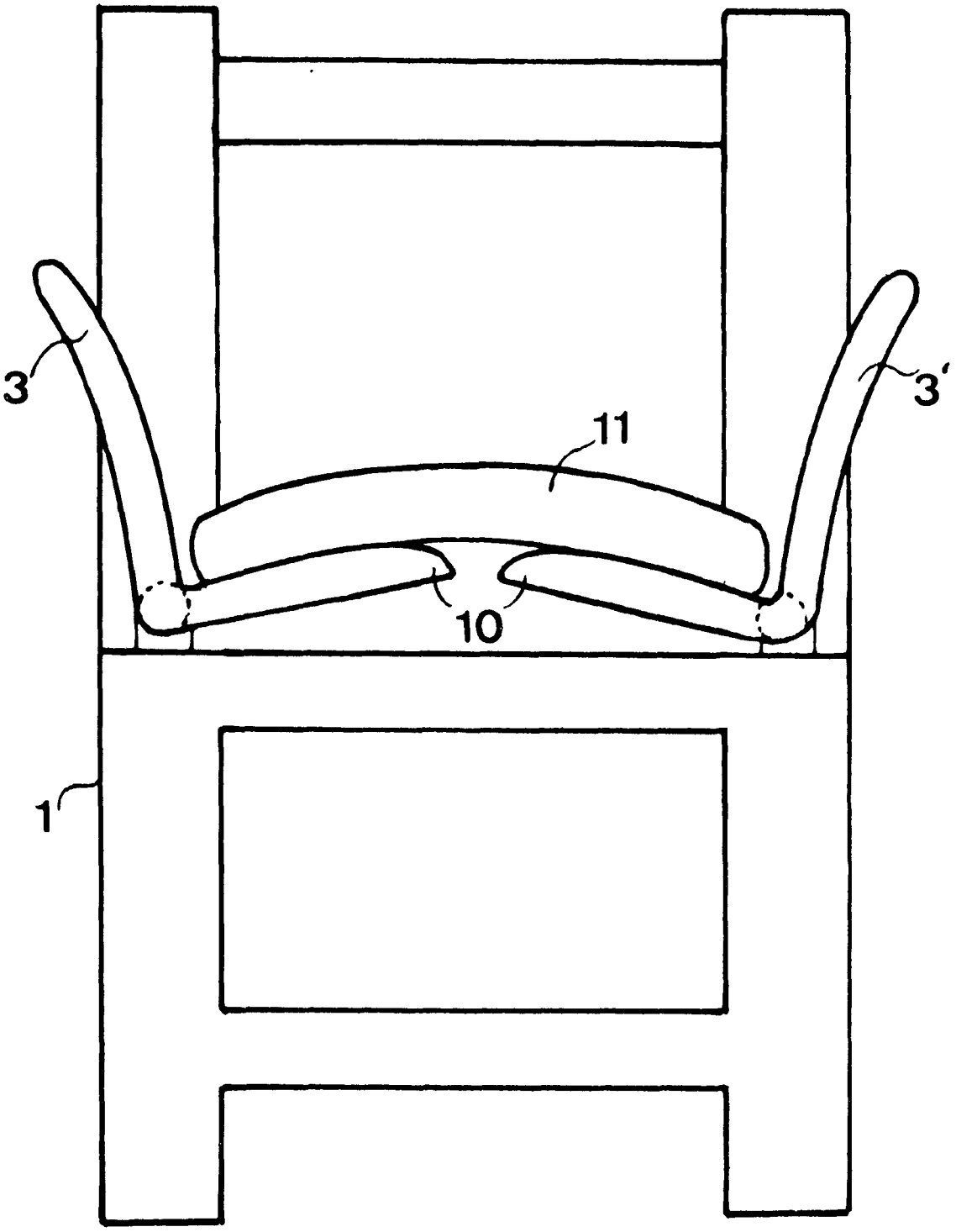
FIG. 6 shows a front view of a variant using swinging fins.

FIG. 6 comprises the seat 1, the swinging fins 3 and 3', the plates 10, in the form of elbowed extensions of the fins, virtually at the right angle and the padding 11.

What is claimed is:

1. A body support device in combination with a seat having an upwardly extending seatback comprising: two opposed self-supporting vertical flexible fins attached to said seatback, an elastic vest having a pair of circular reinforcing bands releasably secured by one or more elastic braces to an upward extension of said seatback, said fins having a thickness and height sufficient to extend laterally from said seatback and curve inwardly therefrom in an oval shape, and the ends of said fins maintaining a frontal opening opposite said seatback, a pair of spaced apart parallel shafts secured to a top of said seat, a second pair of opposed flexible fins rotatably attached to said parallel shafts, each said second pair of fins having a first upwardly extending fin side substantially perpendicular to a second horizontally extending fin side, said second fin sides coplanar with said seat top, and said device further having a seat pad bridging said second fin sides.

2. A device according to claim 1, wherein said fins are constructed and arranged with springs and magnetic elements to retain said fins in at least one position.

3. A device according to claim 1, wherein said fins have internal supporting flexible ribs and foam rubber lining.

4. A device according to claim 1, wherein said vest having vertically aligned elastic straps aligned and connected at top ends to one or the other of said reinforcing bands and said vertically aligned straps connected at bottom ends by a horizontal band.

* * * * *